US006345417B2

(12) United States Patent
Leder et al.

(10) Patent No.: US 6,345,417 B2
(45) Date of Patent: Feb. 12, 2002

(54) SLIVER TRUMPET FOR FORMING A SLIVER FROM A FIBER WEB

(75) Inventors: Armin Leder, Mönchengladbach; Gerd Pferdmenges, Jüchen, both of (DE)

(73) Assignee: Trützschler GmbH Co. KG, Mönchengladbach (DE)

( * ) Notice: Subject to any disclaimer, the term of this patent is extended or adjusted under 35 U.S.C. 154(b) by 0 days.

(21) Appl. No.: 09/770,687

(22) Filed: Jan. 29, 2001

(30) Foreign Application Priority Data

Jan. 29, 2000 (DE) ..... 100 03 994
Oct. 20, 2000 (DE) ..... 100 51 998

(51) Int. Cl.[7] ..... D01G 25/00
(52) U.S. Cl. ..... 19/150; 19/157
(58) Field of Search ..... 19/65 A, 65 CR, 19/150, 152, 153, 157, 296, 299

(56) References Cited

U.S. PATENT DOCUMENTS 2,640,229 A * 6/1953 Gwaltney ..... 19/157
3,353,210 A * 11/1967 Herring ..... 19/157
3,825,975 A * 7/1974 Staeheli ..... 19/150
4,722,118 A * 2/1988 Fahmueller ..... 19/65 CR
5,016,322 A * 5/1991 Erni et al. ..... 19/150
5,018,246 A * 5/1991 Leifeld ..... 19/150
5,065,477 A * 11/1991 Eichengerger et al. ..... 19/150
5,095,587 A * 3/1992 Kluttermann et al. ..... 19/150
5,155,879 A * 10/1992 Kluttermann et al. ..... 19/150
5,461,757 A * 10/1995 Leifeld ..... 19/150
6,158,090 A * 12/2000 Patelli et al. ..... 19/157

FOREIGN PATENT DOCUMENTS

DE 22 50 834 4/1973
DE 25 21 481 11/1975
DE 38 39 413 5/1990
DE 39 13 548 10/1990
DE 198 23 805 3/1999

* cited by examiner

*Primary Examiner*—John J. Calvert
*Assistant Examiner*—Gary L. Welch
(74) *Attorney, Agent, or Firm*—VENABLE; Gabor J. Kelemen

(57) ABSTRACT

A fiber sliver producing apparatus includes an arrangement for making a running fiber web; a transverse web gathering device gathering the fiber web; and a sliver trumpet through which the gathered fiber web passes for being densified and discharged thereby as a running sliver. The sliver trumpet has a cross-sectionally rectangular outlet opening which has a width that is at least 10 times greater than its height. The apparatus further has a calender roll pair formed of two calender rolls through which the sliver passes after being discharged by the sliver trumpet. The calender roll pair defines a bight in which the outlet opening of the sliver trumpet is disposed.

21 Claims, 5 Drawing Sheets

SLIVER TRUMPET FOR FORMING A SLIVER FROM A FIBER WEB

CROSS REFERENCE TO RELATED APPLICATION

This application claims the priority of German Application Nos. 100 03 994.4 filed Jan. 29, 2000 and 100 51 998.9 filed Oct. 20, 2000, which are incorporated herein by reference.

BACKGROUND OF THE INVENTION

This invention relates to an apparatus integrated in a carding machine or a roller card unit for forming a sliver from a fiber web. The apparatus has a roll assembly, formed of a doffer, a stripping roll and a crushing roll pair. The apparatus further has a web gathering and advancing unit as well as a sliver trumpet followed by a calender (pull-off) roll pair. The sliver trumpet densifies the web and discharges a sliver. The sliver exiting the trumpet is introduced into the calender roll pair.

In practice, in the fiber batt processing industry, roller card units and carding machines are used which, for forming a fiber web, have a transitional guide plate (open web triangle), a standing roll pair and a downstream-arranged calender unit. It is a disadvantage of these known arrangements that the cross section of the produced sliver significantly deviates from a rectangular shape. It is also a drawback that the fiber material is not uniformly distributed over the sliver cross section. The thus-produced intermediate product (sliver) leads to irregularities during further processing to obtain the final product, such as a hygiene item.

German patent document 22 50 834 describes a transverse web gathering device which has a conveyor belt and a conveyor roll, followed by a sliver trumpet to form a sliver from a fiber web. The fiber web, after being densified in a closed zone, leaves the transverse gathering device and runs through a sliver trumpet and calender rolls and is thereafter deposited into a sliver can. The roll nip in the transverse gathering device is narrow and the inlet of the trumpet is at a substantial distance from the outlet of the transverse gathering device. The outlet of the trumpet has a circular cross section, and thus the exiting sliver assumes a circular cross section as well. The trumpet outlet is situated at a distance upstream of the bight defined by the calender roll pair. Such an apparatus is not adapted to form a sliver having a rectangular—particularly sharp-edged—cross section. It is a further disadvantage of the known arrangement that because of the distances of the trumpet inlet from the transverse web gathering device, on the one hand, and the trumpet outlet from the calender nip, on the other hand, the processing of the fiber material having a significant amount of short fibers is not possible. Also, the above-noted relatively large distances do not allow a high delivery speed.

SUMMARY OF THE INVENTION

It is an object of the invention to provide an improved apparatus of the above-outlined type from which the discussed disadvantages are eliminated and which, in particular, produces an improved sliver having a rectangular cross section and which further permits a production rate higher than heretofore.

This object and others to become apparent as the specification progresses, are accomplished by the invention, according to which, briefly stated, the fiber sliver producing apparatus includes an arrangement for making a running fiber web; a transverse web gathering device gathering the fiber web; and a sliver trumpet through which the gathered fiber web passes for being densified and discharged thereby as a running sliver. The sliver trumpet has a cross-sectionally rectangular outlet opening which has a width that is at least 10 times greater than its height. The apparatus further has a calender roll pair formed of two calender rolls through which the sliver passes after being discharged by the sliver trumpet. The calender roll pair defines a bight in which the outlet opening of the sliver trumpet is disposed.

By virtue of the measures according to the invention a sliver having a rectangular cross section may be produced which has a more uniform fiber distribution and a significantly increased output speed (at least 100 m/min) compared to prior art arrangements. In particular, the processing of the fiber material with a higher short-fiber proportion is advantageously feasible.

DESCRIPTION OF THE PREFERRED EMBODIMENTS

Figure 1:
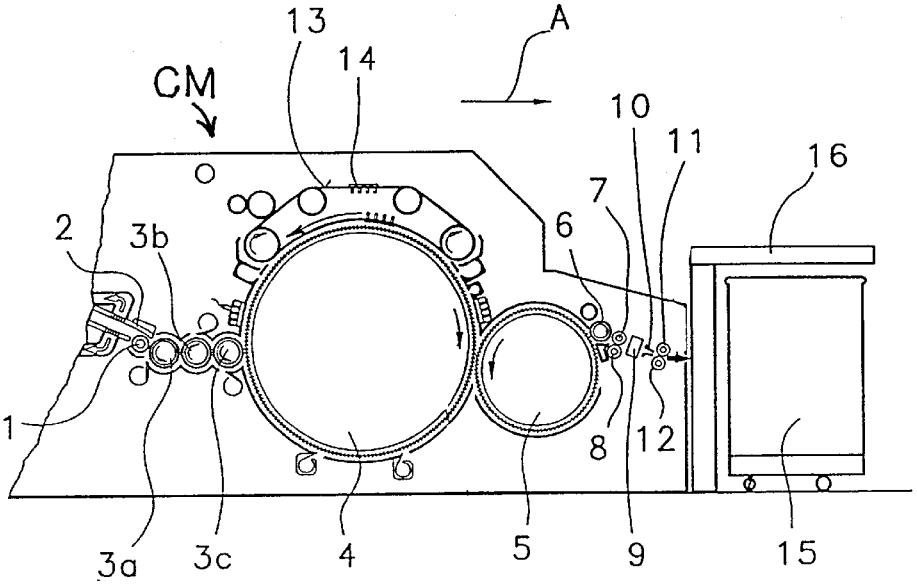
FIG. 1 is a schematic side elevational view of a carding machine incorporating the invention.

FIG. 1 illustrates a carding machine CM which may be, for example, a high-performance DK 903 carding machine manufactured by Trützschler GmbH & Co. KG, M önchengladbach, Germany. The carding machine CM has a feed roll 1, a feed table 2 cooperating therewith, licker-ins 3*a*, 3*b*, 3*c*, a main carding cylinder 4, a doffer 5, stripping rolls 6, cooperating crushing rolls 7, 8, a web guiding element (transverse web gathering device) 9, a sliver trumpet 10, calender rolls 11, 12 and a travelling flats assembly 13 having slowly circulating flat bars 14. The rotary direction of the carding machine rolls is indicated by curved arrows drawn thereinto. At the output of the carding machine a coiler device 16 is provided which deposits the sliver into a coiler can 15. The working direction, that is, the advancing direction of the fiber material in the carding machine is designated with the arrow A.

Figure 2:
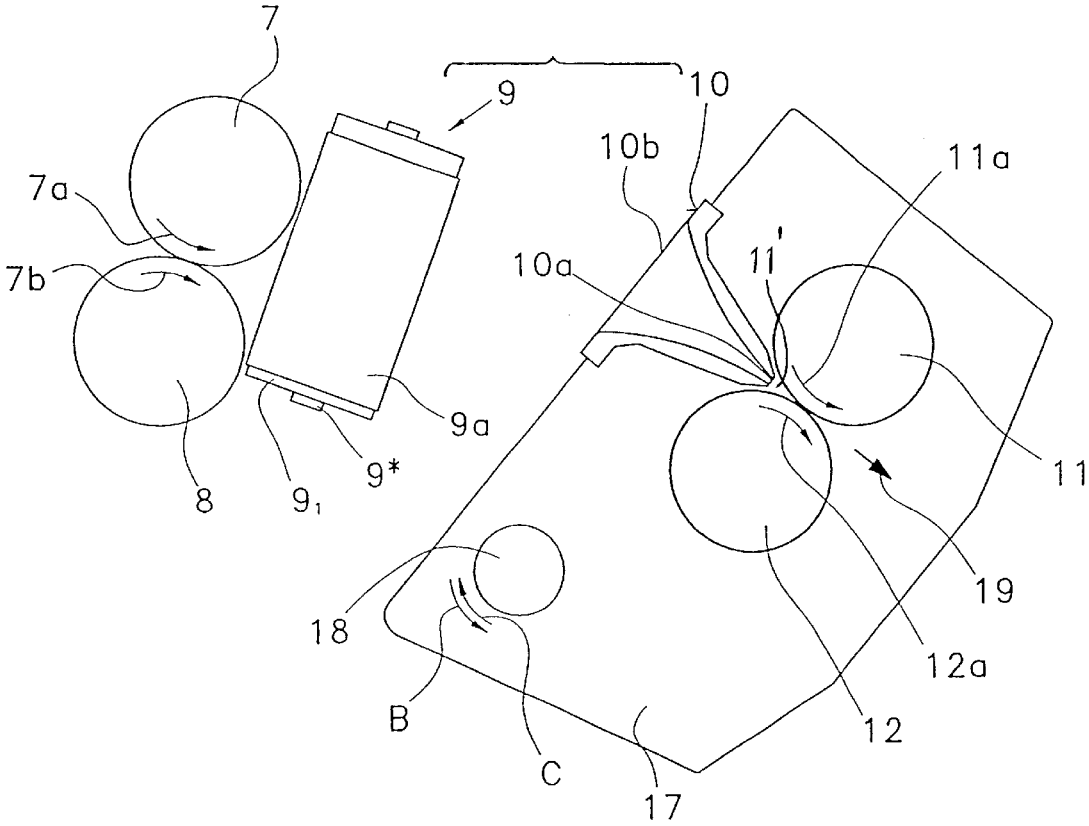
FIG. 2 is an enlarged schematic side elevational view of one part of the structure shown in FIG. 1.
Figure 3:
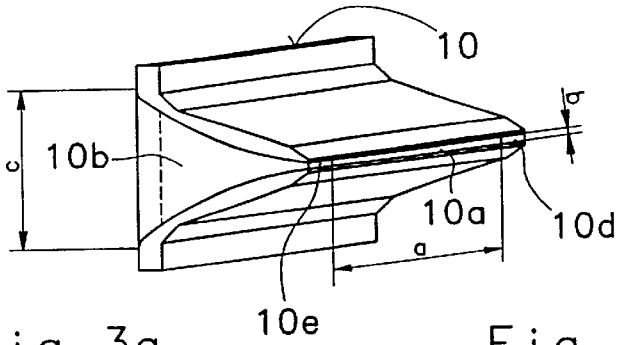
FIG. 3 is a perspective view of a preferred embodiment of the sliver trumpet according to the invention.
Figure 3A:
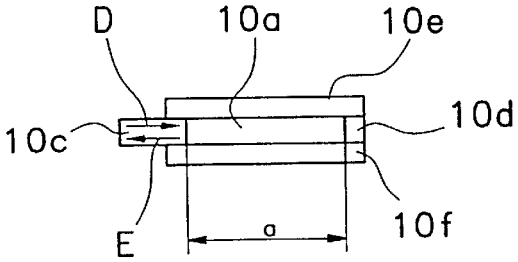
FIG. 3*a* is a front elevation of the sliver trumpet, showing an adjustable wall element in the outlet region.
Figure 3B:
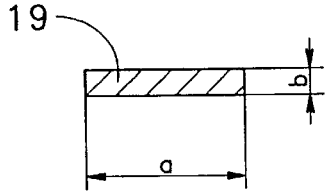
FIG. 3*b* is a cross-sectional view of the sliver exiting the sliver trumpet.

Turning to FIGS. 2 and 3, the transverse web gathering element 9, the sliver trumpet 10 and the calender rolls 11 and 12 rotating in the direction indicated by the arrows 11*a* and 12*a,* are arranged downstream of the crushing rolls 7 and 8 which rotate in the direction indicated by the arrows 7*a* and 7*b,* respectively. The sliver trumpet 10 and the calender rolls 11, 12 are mounted on a holding device 17 which may turn in the direction of the arrows B and C about a fixed shaft 18. The inner passage of the sliver trumpet 10 converges in the working direction A. The height c of the inlet opening 10*b* is greater than the height b of the outlet opening 10*a*. The height b of the outlet opening 10*a* of the sliver trumpet 10 is approximately 2–3 mm. The width a of the outlet opening 10*a* of the sliver trumpet 10 is between approximately 20–100 mm, preferably 60–90 mm. The width a may be changed—as shown in FIG. 3*a*—by a wall element 10*c* in the region of the outlet opening 10*a* by shifting it in the direction of the arrow D or E. The outlet opening 10*a* is rectangular and is bounded by sharp edges. As a result of this construction the flat sliver 19 exiting the sliver trumpet 10 has, as shown in FIG. 3*b,* a sharp-edged rectangular cross-sectional shape. As shown in FIG. 2, the outlet opening 10*a* of the sliver trumpet 10 is situated in the intake bight 11' defined between the calender rolls 11 and 12. The inlet opening 10*b* of the sliver trumpet 10 is chamfered and has an elongate shape. The inner trumpet walls 10*d* and 10*e* extending in the region of the trumpet outlet opening 10*a* along the width thereof, are parallel to one another.

Figure 4A:
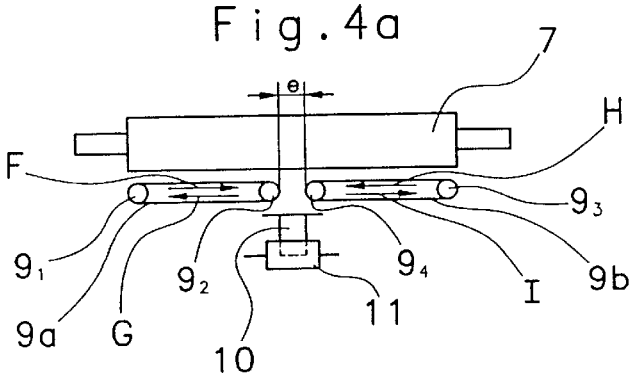
FIG. 4*a* is a schematic front elevational view of a preferred embodiment of the invention in which a crushing roll pair (only one roll is visible), a transverse gathering device, a sliver trumpet and a calender roll pair (only one roll is visible) are in a vertical arrangement.
Figure 4B:
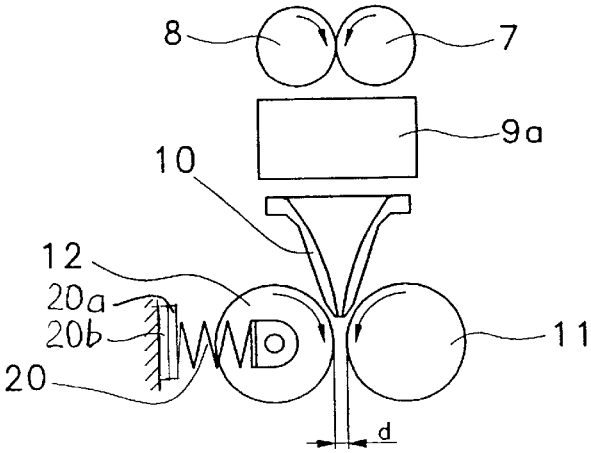
FIG. 4*b* is a side elevational view of the construction illustrated in FIG. 4*a*.

As shown in FIGS. 4*a* and 4*b,* the axially parallel crushing rolls 7 and 8 are horizontally arranged and are followed perpendicularly downward by the transverse web gathering element 9, the sliver trumpet 10 and the calender rolls 11 and 12.

The transverse web gathering element 9 has two endless flexible conveyor belts 9*a,* 9*b* supported by end rolls $\mathbf{9}_1$, $\mathbf{9}_2$ and, respectively, $\mathbf{9}_3$, $\mathbf{9}_4$. In each instance, one end roll for each belt, for example, the end rolls $\mathbf{9}_1$ and $\mathbf{9}_3$ are driven by a respective shaft 9* (shown in FIG. 2) by a non-illustrated, preferably common driving device. The belt flights of the conveyor belts 9*a,* 9*b* move in directions illustrated by the arrows F, G and H, I.

The calender roll 12 is biased by a compression spring 20 and is radially movably supported relative to the radially stationary calender roll 11, whereby the width d of the nip between the calender rolls 11 and 12 as well as the pressure on the sliver may be adjusted. The force of the spring may be adjusted, for example, by inserting washers 20*a,* 20*b* of suitable thickness between a spring end and a spring support. If a subsequent doubling of the fiber web is effected prior to further processing, an excessive pressing of the calender rolls 11, 12 may cause damage whereas if an immediate further processing is carried out, then a greater compression force is desirable.

Figure 5:
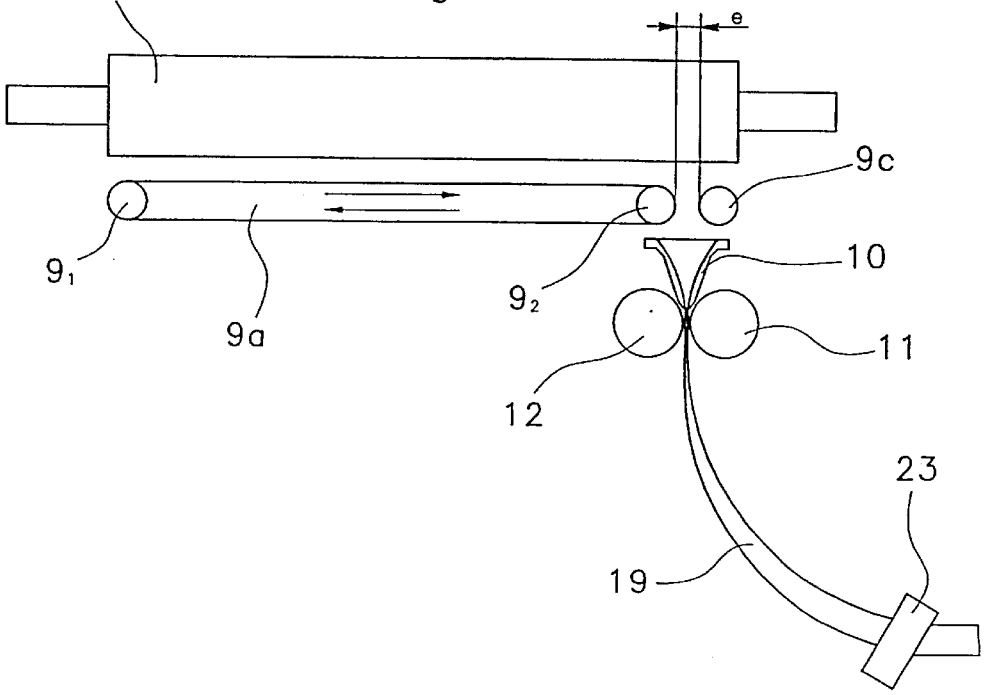
FIG. 5 is a schematic front elevational view of another preferred embodiment of the invention, including a conveyor belt and a conveyor roll, calender rolls arranged parallel to the conveyor roll and a deflecting roll.

Turning to FIG. 5, the transverse web gathering element 9 is composed of a conveyor belt 9*a* and a conveyor roll 9*c* defining together a nip (exit gap) having a width e which has a clearance of preferably approximately 10 mm. The web material passes through the nip in direct contact with the conveyor belt 9*a* and the conveyor roll 9*c*. The axes of the end rolls $\mathbf{9}_1$, $\mathbf{9}_2$ (supporting the belt 9*a*), the conveying roll 9*c* and the calender rolls 11, 12 are arranged in a parallel orientation. By virtue of the parallel arrangement of the calender rolls 11, 12, the web material lying on the belt 9*a* is packed in an even more pronounced manner into the rectangular cross-sectional shape of the web by the transverse web gathering element 9. Downstream of the calender rolls 11, 12 a sliver deflecting roll 23 is arranged.

Figure 6:
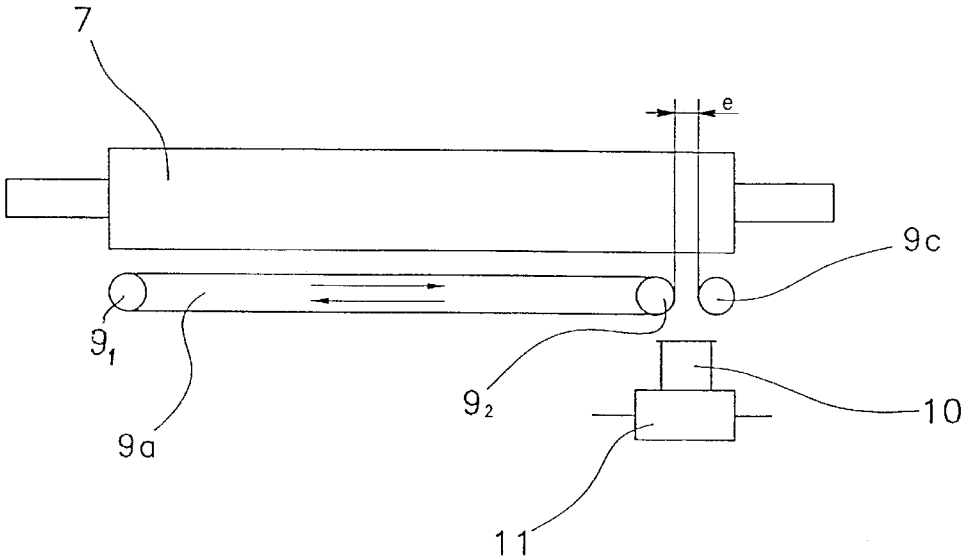
FIG. 6 is a schematic front elevational view of a further preferred embodiment of the invention having calender rolls oriented perpendicularly to the conveyor roll.

According to FIG. 6, in contrast to FIG. 5, the width of the sliver trumpet 10 and the axes of the calender rolls 11, 12 are perpendicular to the axes of the end rolls $\mathbf{9}_1$, $\mathbf{9}_2$ and the conveying roll 9*c*. The advantageous arrangement of the sliver trumpet 10 with respect to the transverse web gathering element 9 also depends from the width a of the outlet opening 10*a* and from the processed fiber material.

To obtain an optimal web structure for the consecutive material distribution in the rectangular trumpet 10, the width e of the outlet nip according to FIGS. 4*a,* 5 and 6 between the end roll $\mathbf{9}_2$ on the one hand and the end roll $\mathbf{9}_4$ or the conveying roll 9*c* on the other hand, has to have a minimum dimension, for example, at least 10 mm to avoid a premature compression of the web at that location.

Figure 7A:
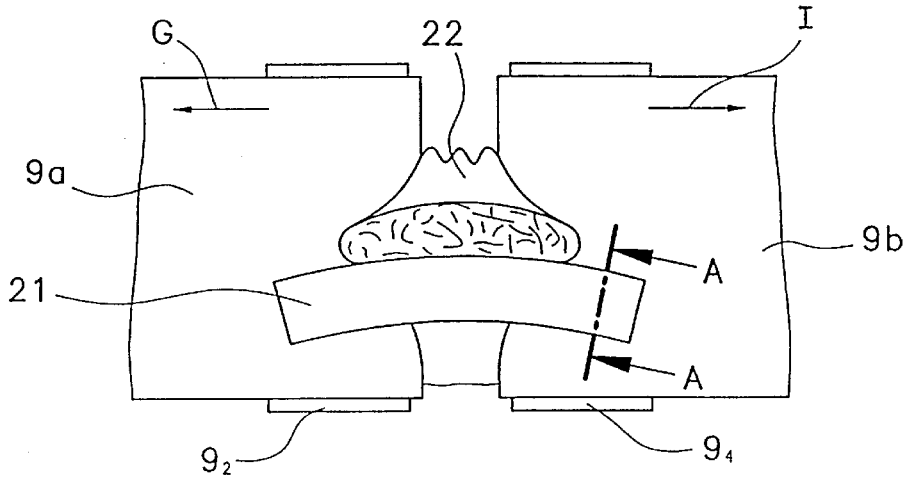
FIG. 7*a* is a schematic front elevational view of the gap region between the web conveyor belts which have an after-connected web spreading element.
Figure 7B:
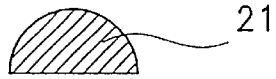
FIG. 7*b* is a sectional view taken along line VIIb—VIIb of FIG. 7*a*.
Figure 7C:
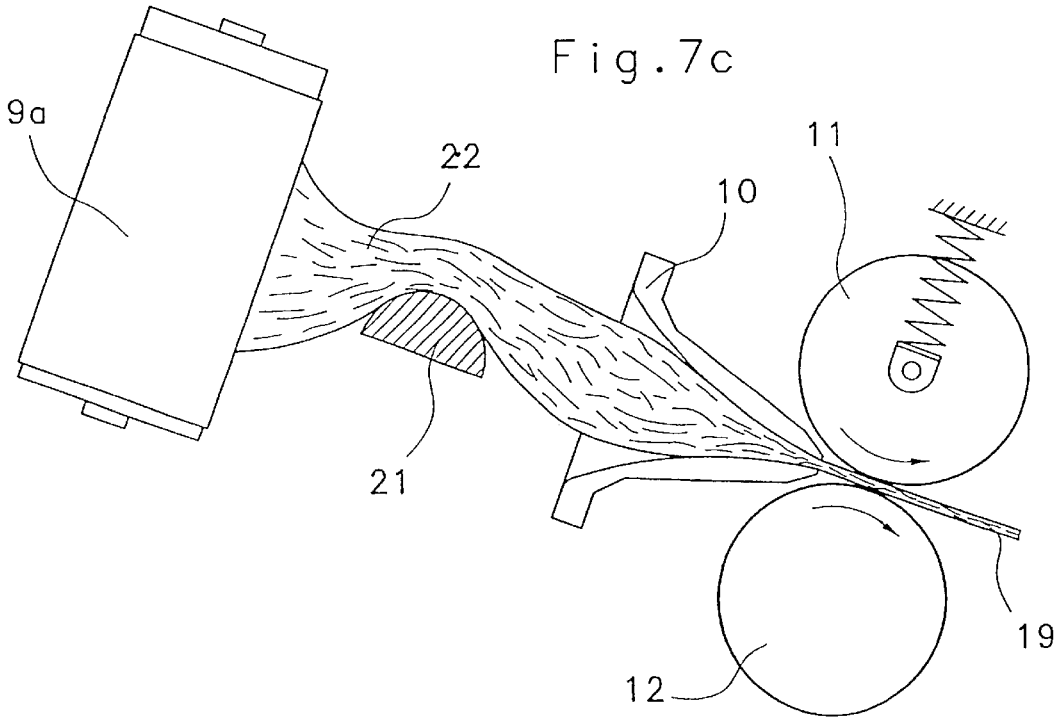
FIG. 7*c* is a schematic side elevational view of the structure shown in FIG. 7*a* including an after-connected sliver trumpet and calender rolls.

Turning to FIGS. 7*a,* 7*b* and 7*c,* subsequent to leaving the web gathering device 9, a web widening prior to its entering the rectangular sliver trumpet 10 may be advantageous for a desired width a of the exiting sliver 19 (final sliver width). For this purpose an arcuate web spreading element 21 is provided which is arranged between the transverse web gathering element 9 and the inlet 10*b* of the sliver trumpet 10. The web spreading element 21 is a bent bar having an approximately semicircular cross section as shown in FIG. 7*b*. The sliver 22 exiting the outlet nip of the web gathering device 9 runs over the upper, convexely bent region of the web spreading element 21 and is thus laterally spread thereby. The gathered web 22 subsequently passes through the sliver trumpet 10 and is pulled off the outlet opening 10*a* by the calender rolls 11, 12 as a flat sliver 19 having a rectangular, uniform cross section.

Figure 8:
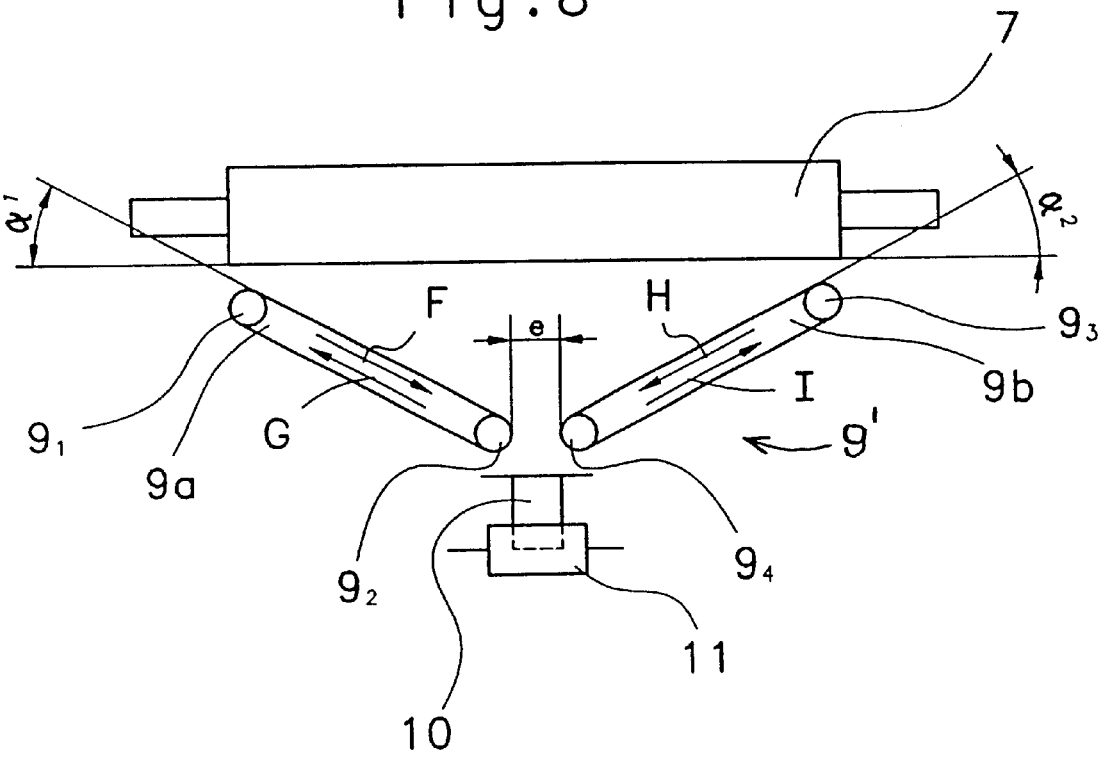
FIG. 8 is a schematic front elevational view of a variant of the structure illustrated in FIG. 4*a*.

In a variant shown in FIG. 8, the conveyor belts 9*a* and 9*b* of the web gathering device 9' are arranged at an oblique angle $\alpha_1$ and $\alpha_2$ with respect to the axis of the crushing rolls 7 and 8 (only the crushing roll 7 is visible). The oblique angle is approximately between 30° and 45°.

It will be understood that the above description of the present invention is susceptible to various modifications, changes and adaptations, and the same are intended to be comprehended within the meaning and range of equivalents of the appended claims.

What is claimed is:

1. A fiber sliver producing apparatus comprising (a) means for making a running fiber web;

(b) a transverse web gathering device gathering the fiber web;

(c) a sliver trumpet through which the gathered fiber web passes for being densified and discharged thereby as a running sliver; said sliver trumpet having a cross-sectionally rectangular outlet opening; said outlet opening having a width and a height; said width being at least 10 times greater than said height; and (d) a calender roll pair formed of two calender rolls through which said sliver passes after being discharged by said sliver trumpet; said calender roll pair defining a bight in which said outlet opening of said sliver trumpet is disposed.

2. The apparatus as defined in claim 1, wherein said width is at least 30 times greater than said height.

3. The apparatus as defined in claim 1, wherein said transverse web gathering device comprises a conveyor belt for receiving, conveying and gathering the web.

4. The apparatus as defined in claim 1, wherein said transverse web gathering device comprises two oppositely running, longitudinally aligned conveyor belts for receiving, conveying and gathering the web.

5. The apparatus as defined in claim 1, wherein said transverse web gathering device comprises a conveyor belt for receiving, conveying and gathering the web and a conveyor roll cooperating with said conveyor belt for advancing the web toward said sliver trumpet.

6. The apparatus as defined in claim 1, further comprising a crushing roll pair through which the web passes; said transverse web gathering device being positioned immediately downstream of said crushing roll pair as viewed in a direction of advance of the web through said crushing roll pair.

7. The apparatus as defined in claim 1, further comprising a web spreading element disposed between said sliver trumpet and said transverse web gathering device.

8. The apparatus as defined in claim 1, wherein said sliver trumpet has an inlet opening of elongate shape.

9. The apparatus as defined in claim 1, wherein said sliver trumpet has an elongate, chamfered inlet opening.

10. The apparatus as defined in claim 1, further wherein said sliver trumpet includes a shiftable side wall for varying said width of said outlet opening.

11. The apparatus as defined in claim 1, wherein said sliver trumpet has opposite inner walls extending along said width of said outlet opening; said inner walls being parallel to one another.

12. The apparatus as defined in claim 1, further comprising a crushing roll pair through which the web passes; said transverse web gathering device being positioned underneath said crushing roll pair.

13. The apparatus as defined in claim 1, wherein said sliver trumpet is positioned underneath said transverse web gathering device and said calender roll pair is positioned underneath said sliver trumpet.

14. The apparatus as defined in claim 1, wherein at least one of said calender rolls is radially displaceable toward and away from the other of said calender rolls; further comprising a spring for biasing said one calender roll toward said other calender roll.

15. The apparatus as defined in claim 14, further comprising means for adjusting the force of said spring.

16. The apparatus as defined in claim 1, wherein said outlet opening is bounded by sharp edges.

17. The apparatus as defined in claim 1, further comprising a crushing roll pair through which the web passes; the crushing rolls of the crushing roll pair having rotary axes oriented parallel to one another; said transverse web gathering device being positioned downstream of said crushing roll pair as viewed in a direction of advance of the web through said crushing roll pair; wherein said transverse web gathering device comprises two oppositely running conveyor belts for receiving, conveying and gathering the web; said conveyor belts being arranged at an oblique angle to said axes of said crushing rolls.

18. The apparatus as defined in claim 17, wherein said oblique angle is approximately between 30° and 45°.

19. The apparatus as defined in claim 1, wherein said transverse web gathering device has a nip through which the gathered web is discharged, said nip having a clearance of at least approximately 10 mm.

20. A fiber sliver producing apparatus comprising (a) means for making a running fiber web;

(b) a transverse web gathering device gathering the fiber web; said transverse web gathering device including
  (1) a conveyor belt for receiving, conveying and gathering the web; and
  (2) a conveyor roll directly cooperating with said conveyor belt for advancing the web between said conveyor belt and said conveyor roll by directly contacting said conveyor belt and said conveyor roll;

(c) a sliver trumpet receiving the gathered fiber web from said web gathering device for densifying and discharging the web as a running sliver; said sliver trumpet having a cross-sectionally rectangular outlet opening; said outlet opening having a width and a height; said width being at least 10 times greater than said height; and (d) a calender roll pair formed of two calender rolls through which said sliver passes after being discharged by said sliver trumpet.

21. A fiber sliver producing apparatus comprising (a) means for making a running fiber web;

(b) a transverse web gathering device gathering the fiber web;

(c) a sliver trumpet through which the gathered fiber web passes for being densified and discharged thereby as a running sliver; said sliver trumpet having a cross-sectionally rectangular outlet opening; said outlet opening having a width and a height; said width being at least 10 times greater than said height;

(d) a calender roll pair formed of two calender rolls through which said sliver passes after being discharged by said sliver trumpet; said calender roll pair defining a bight in which said outlet opening of said sliver trumpet is disposed; and (e) a web spreading element disposed between said sliver trumpet and said transverse web gathering device.

* * * * *